US008499704B2

(12) United States Patent
Kim

(10) Patent No.: US 8,499,704 B2
(45) Date of Patent: Aug. 6, 2013

(54) MOTOR PULLEY FOR OVERLOCK SEWING MACHINE

(75) Inventor: Dong Woo Kim, Incheon (KR)

(73) Assignee: SunStar Co., Ltd., Incheon (KR)

( * ) Notice: Subject to any disclaimer, the term of this patent is extended or adjusted under 35 U.S.C. 154(b) by 5 days.

(21) Appl. No.: 13/287,266

(22) Filed: Nov. 2, 2011

(65) Prior Publication Data

US 2012/0111250 A1 May 10, 2012

(30) Foreign Application Priority Data

Nov. 4, 2010 (KR) ..... 10-2010-0109171

(51) Int. Cl.
*D05B 71/00* (2006.01)

(52) U.S. Cl.
USPC ..... 112/280

(58) Field of Classification Search
USPC ..... 112/280, 270, 275, 258, 220
See application file for complete search history.

(56) References Cited

U.S. PATENT DOCUMENTS

| | | | | |
|---|---|---|---|---|
| 2,637,489 | A * | 5/1953 | Place | 416/184 |
| 4,115,030 | A * | 9/1978 | Inagaki et al. | 416/93 R |
| 4,154,182 | A * | 5/1979 | Klundt | 112/280 |
| 4,643,644 | A * | 2/1987 | Colliver et al. | 416/174 |
| 5,207,167 | A * | 5/1993 | Inomata | 112/280 |

* cited by examiner

*Primary Examiner* — Tejash Patel
(74) *Attorney, Agent, or Firm* — LRK Patent Law Firm

(57) ABSTRACT

A motor pulley for an overlock sewing machine is provided. The motor pulley includes a frame which forms a body of the pulley, and a plurality of ribs which are integrally formed with the frame. Each rib is oriented in a radial direction at a predetermined angle displaced from an axial center line of the pulley. The motor pulley further includes a ramp which is formed on one side surface of each of the ribs, and a slot which is formed in the pulley so that outside air can enter the motor pulley. The motor pulley of the present invention increases the flow rate of air that is blown from the pulley to a motor of the overlock sewing machine. Furthermore, the path of air flow of the motor pulley is improved, thus reducing a loss of air flow and increasing the flow rate of air.

5 Claims, 13 Drawing Sheets
(3 of 13 Drawing Sheet(s) Filed in Color)

MOTOR PULLEY FOR OVERLOCK SEWING MACHINE

CROSS REFERENCE TO RELATED APPLICATION

This application claims the benefit under 35 U.S.C. 119(a) of Korean Patent Application No. 10-2010-0109171, filed on Nov. 4, 2010, the disclosure of which is incorporated by reference in its entirety for all purposes.

BACKGROUND OF THE INVENTION

1. Field of the Invention

The present invention relates generally to motor pulleys for overlock sewing machines and, more particularly, to a motor pulley for an overlock sewing machine which is configured such that the flow rate of air which is blown from the pulley to a motor side of the overlock sewing machine is markedly increased, and which has an improved path of air flow, thus reducing a loss of air flow and increasing the flow rate of air.

2. Description of the Related Art

Generally, an overlock sewing machine is a sewing machine which sews over the edge of cloth to prevent it from running. The overlock sewing machine needs a motor pulley for cooling elements, such as a motor, a frame, an oil pan, etc., of the sewing machine, because the sewing speed of the sewing machine is comparatively high.

FIG. 1 shows an example of a conventional motor pulley. Fan blades 2 are integrally provided in a frame 1 of a handwheel. A metal shaft sleeve 4 which is coupled to the output shaft of a motor is fitted into a core part 3 of the handwheel. The fan blades 2 are integrally formed with the frame 1 by injection molding.

In the conventional motor pulley having the above-mentioned construction, the effect of dissipating heat generated from the motor can be improved by providing the fan on the handwheel frame 1. In addition, because the fan blades 2 and the handwheel frame 1 are integrally formed by injection molding, the process of manufacturing the motor pulley is simple, and the production cost can be reduced.

However, the conventional motor pulley, having the effect of dissipating heat of the motor adjacent to the pulley, is problematic in that the area of direct contact that the air blown from the pulley makes with the oil pan and the outer wall of the apparatus is reduced, because the pulley blows air to the outside of the apparatus. In the case of a cooling system of an overlock machine in which oil of the oil pan is dispersed by an oil pump into the apparatus, the cooling efficiency is lowered.

Meanwhile, FIG. 2 illustrates a motor pulley according to another conventional technique. The motor pulley of FIG. 2 is a closed pulley with radial ribs and is configured such that air is sent to a motor side by the ribs 12 provided in the pulley 10 when rotating. A metal shaft sleeve 14 which is coupled to the output shaft of the motor is fitted into a core part of the pulley 10. The ribs 12 are integrally formed with the pulley 10 by injection molding.

In this conventional motor pulley, the motor is cooled by the radial ribs 12. The motor pulley is a closed shape so that outside impurities are prevented from entering the pulley.

However, because the pulley does not provide a path along which to draw outside air into the pulley, an air eddy phenomenon is caused inside the pulley, thus reducing the flow rate of air blown from the pulley.

Further, although this conventional motor pulley could be effective at cooling a motor of a low-speed sewing machine, the cooling efficiency is lowered in an oil scattering cooling system of a high-speed sewing machine, such as an overlock sewing machine, because the flow rate of air is comparatively low.

FIG. 3 illustrates a conventional open pulley with radial ribs 22, configured such that air is sent to a motor side by the ribs 22 provided in the pulley when rotating. This pulley has additional slots 24 so that outside air is drawn into the pulley.

This conventional motor pulley cools the motor using the radial ribs 22, has the slots 24 to mitigate an air eddy phenomenon, and increases the flow rate of air that enters the pulley, thus enhancing the flow rate of air that is blown from the pulley to the motor.

However, in this conventional motor pulley, because the ribs 22 are arranged in radial directions around the axis of the pulley to be aligned with the axis of the pulley, as shown in FIG. 4, the direction of air flow is oriented outwards rather than being oriented towards the central axis of pulley. Thus, the flow rate of air that is blown from the pulley is limited. Therefore, a motor pulley has been required, which exhibits satisfactory cooling efficiency even in an oil dispersing cooling system of a high-speed sewing machine, such as an overlock sewing machine.

SUMMARY OF THE INVENTION

Accordingly, the present invention has been made keeping in mind the above problems occurring in the prior art, and an object of the present invention is to provide a motor pulley for an overlock sewing machine which can enhance air blowing performance, thus increasing the effect of cooling a motor and enhancing the cooling ability of an oil dispersing cooling system.

Another object of the present invention is to provide a sewing machine with the motor pulley having improved air blowing performance to increase the effect of cooling the motor and enhance the cooling ability of an oil dispersing cooling system.

In order to accomplish the above object, the present invention provides a motor pulley for cooling a motor of an overlook sewing machine, including: a frame forming a body of the motor pulley; a plurality of ribs integrally formed with the frame, each of the ribs oriented in a radial direction at a predetermined angle displaced from an axial center line; a ramp formed on one side surface of each of the ribs; and a slot formed in the frame to allow outside air to enter the motor pulley therethrough.

Each of the ribs may be displaced at an angle ranging from 35° to 55° with respect to the axial center line. It may be most preferable for the angle at which each rib is angled to the axial center line to be 45°.

Furthermore, an angle of the ramp may range from 35° to 55°.

In addition, a corner of an inner surface of the frame may be rounded to improve the path of air flow.

Moreover, an edge of the slot may be rounded to improve the path of air flow.

In order to accomplish the above object, the present invention provides a sewing machine having the motor pulley.

BRIEF DESCRIPTION OF THE DRAWINGS

The patent or application file contains at least one drawing executed in color. Copies of this patent or patent application publication with color drawings will be provided by the Office upon request and payment of the necessary fee.

The above and other objects, features and advantages of the present invention will be more clearly understood from the following detailed description taken in conjunction with the accompanying drawings, in which:

FIGS. 7A and 7B compare a rib of the pulley of the present invention with a conventional rib, wherein FIG. 7A is a perspective view illustrating the flow of air against a conventional right-angled rib, and FIG. 7B is a perspective view illustrating the flow of air against a rib having a ramp according to the present invention;

FIGS. 8A and 8B compare the pulley of the present invention with a conventional pulley, wherein FIG. 8A is a perspective view illustrating the flow of air in the conventional pulley, and FIG. 8B is a perspective view illustrating the flow of air in the pulley of the present invention;

FIGS. 9A and 9B compare the pulley of the present invention with a conventional pulley, wherein FIG. 9A is a perspective view illustrating the inflow of air into the pulley through a slot according to the conventional technique, and FIG. 9B is a perspective view illustrating the inflow of air into the pulley through a slot according to the present invention; and FIGS. 10 and 11A-11C illustrate the results of a test to configure the best shape of the pulley derived from the applicant of the present invention, wherein FIG. 10 is of photographs showing the internal shapes of Case 1 to Case 9, and FIGS. 11A-11C show the result of a simulation analyzing the velocity and pressure for Case 9 that is an embodiment of the present invention, wherein FIG. 11A shows the flow of air, FIG. 11B shows the distribution of pressure due to the inflow of air, and FIG. 11C shows the distribution of air flow velocity.

DESCRIPTION OF THE PREFERRED EMBODIMENTS

Hereinafter, a preferred embodiment of a motor pulley according to the present invention will be described in detail with reference to the attached drawings.

Figure 5:
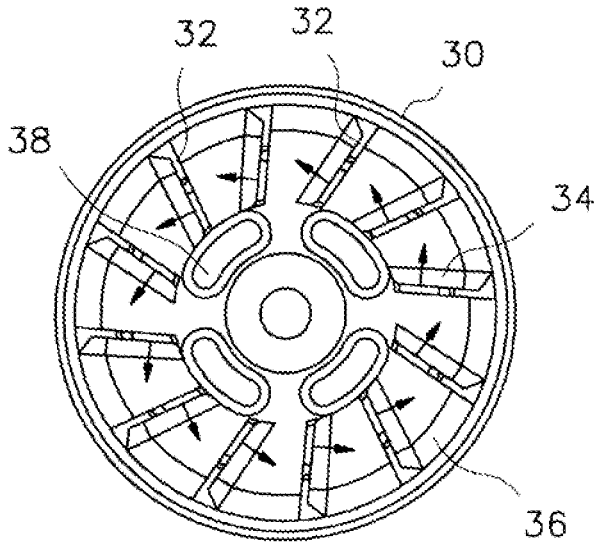
FIG. 5 is a front view showing the internal structure of a pulley according to the present invention.
Figure 6:
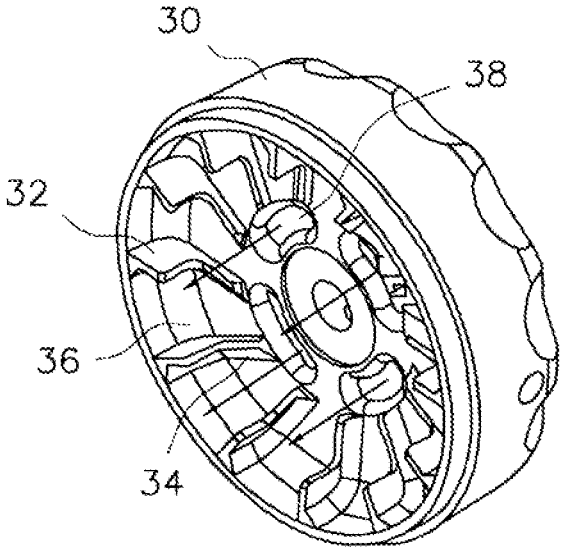
FIG. 6 is a perspective view showing the inflow of air into the pulley according to the present invention.

FIG. 5 is a front view showing the internal structure of the motor pulley according to the present invention. FIG. 6 is a perspective view showing the inflow of air into the motor pulley according to the present invention.

The motor pulley of an overlock sewing machine according to the present invention includes a frame 30 which forms a body of the pulley, and a plurality of ribs 32 which are integrally formed with the frame 30. Each of the ribs 32 is oriented in a radial direction at a predetermined angle that is slightly displaced from an axial center line of the motor pulley.

Each rib 32 according to the present invention is characterized by being displaced from the axial center line at a predetermined angle other than being aligned with the axial center line.

Figure 1:
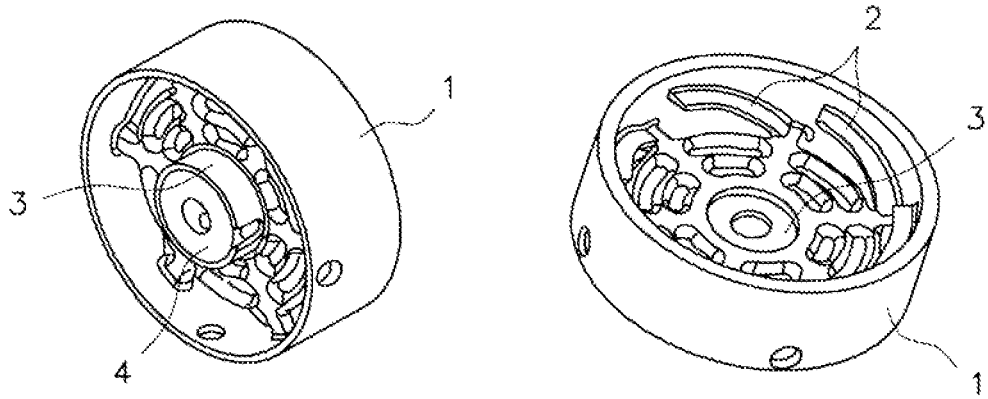
FIG. 1 RELATED ART
FIG. 1 is of perspective views showing an example of a conventional pulley.
Figure 2:
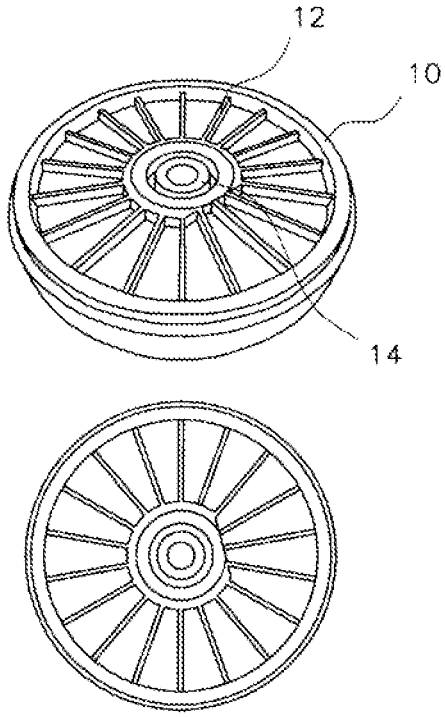
FIG. 2 RELATED ART
FIG. 2 is of photographs showing another example of a conventional pulley.
Figure 3:
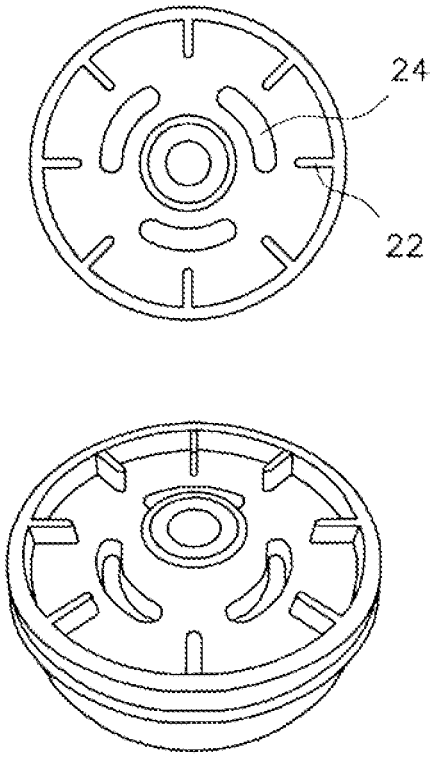
FIG. 3 RELATED ART
FIG. 3 is of photographs showing a further example of a conventional pulley.
Figure 4:
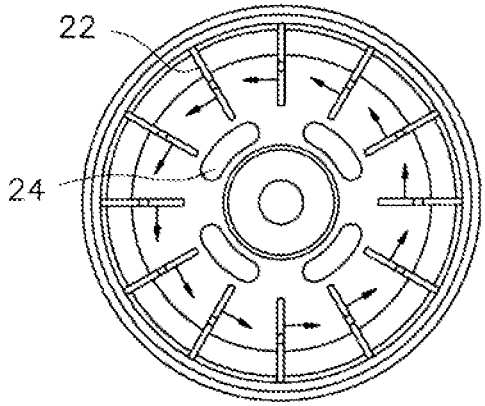
FIG. 4 RELATED ART
FIG. 4 is a view showing the direction of air flow in a conventional pulley having axis-centered radial ribs.

In other words, in the conventional pulley of FIG. 4, each rib 22 is oriented in a radial direction to be aligned with the axial center line of the pulley, whereas each rib 32 of the present invention is displaced at a predetermined angle with respect to the axial center line of the pulley. The angle at which each rib 32 is angled to the axial center line ranges from 35° to 55°.

In the pulley having such ribs 32, as shown in FIG. 5, the direction of air that flows in the pulley is oriented outwards, so that a pressure difference at the center of the pulley increases, thus increasing the flow rate of air that has been drawn into the pulley from the outside, thereby increasing the flow rate of the air that is discharged from the pulley.

That is, unlike the conventional pulley, the direction of air flow derived from the ribs 32 is oriented outwards so that the velocity of air that enters the pulley through the inlets increases.

In detail, due to the increased velocity of air around slots 38 which are connected to the outside, the air pressure difference between the interior and the outside of the pulley increases. Thereby, the flow rate of air entering the pulley is increased, thus enhancing the cooling efficiency.

It is most preferable for the angle at which each rib 32 is angled to the axial center line to be 45°.

Meanwhile, in the motor pulley of the present invention, a ramp 34 is integrally formed on one side surface of each rib 32.

The ramp 34 is formed on the one side surface of the rib 32 that is the surface corresponding to the rotational direction of the pulley. As such, in the case of the pulley according to the present invention with the ribs 32 each of which has the ramp 34 on one side surface thereof, when the pulley rotates, air can smoothly flow along the ramps 34. Therefore, as shown in FIG. 7B, the path of air flow can be improved.

Figure 7A:
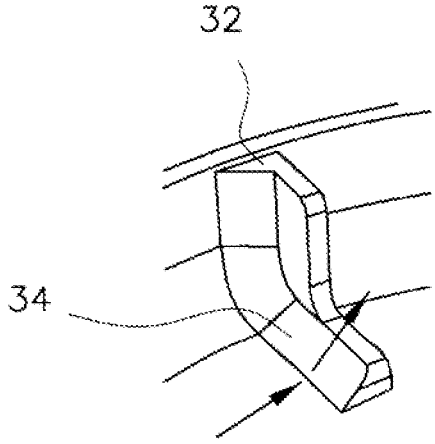
Figure 7B:
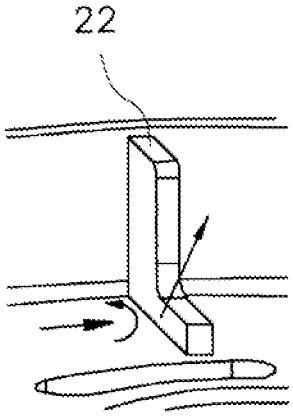

As shown in FIG. 7*a*, in the case of the conventional right-angled rib 22, a phenomenon in which air that has been around the rib collides with air which enters the pulley arises, thus causing a drop in air flow.

However, in the present invention, each rib 32 is provided the ramp 34 to improve the path of air flow so that air can flow over the rib 32 without incurring the drop.

An angle of the ramp 34 ranges from 35° to 55°. Most preferably, the ramp 34 has an angle of 45° to enhance the effect of improvement in the path of air flow.

Figure 8A:
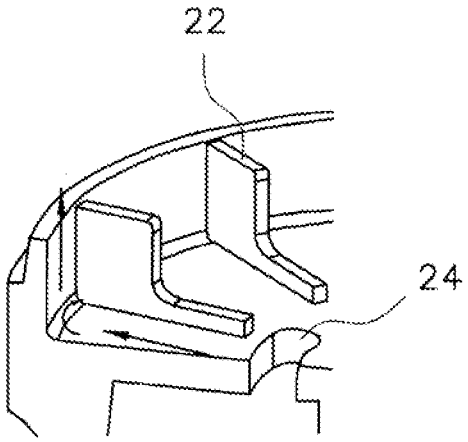
Figure 8B:
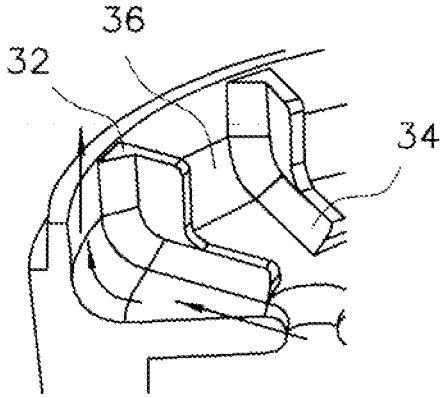

Furthermore, as shown in FIG. 8B, in the pulley of the present invention, an inner corner of the frame 30 is rounded to further improve the path of air flow.

In the case of the conventional technique, as shown in FIG. 8A, the inner corner of the frame forms an almost right angle. This structure also causes the phenomenon in which air that has been in the pulley collides with air entering the pulley.

However, in the pulley according to the present invention, the inner corner of the frame is rounded at a comparatively large radius of curvature, thus further improving the path of air flow. Thereby, an eddy current phenomenon which arises around the corner of the pulley is markedly reduced, thus improving the path of air flow and increasing the flow rate of air.

Figure 9A:
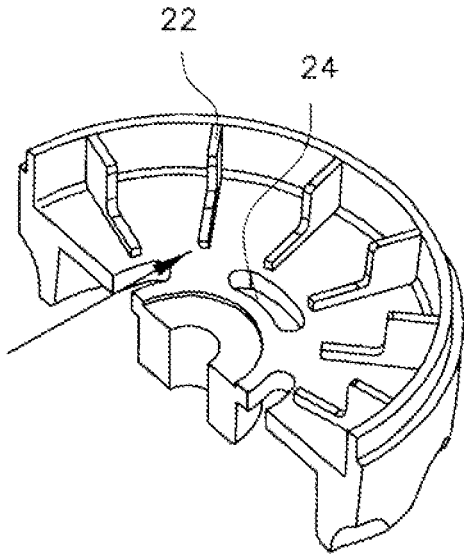
Figure 9B:
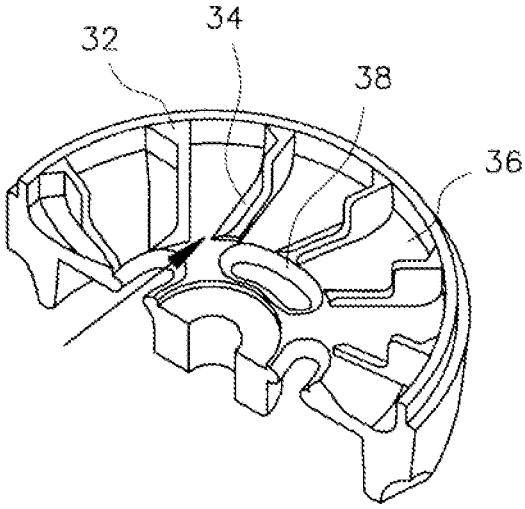

Meanwhile, as shown in FIG. 9B, an edge of each slot 38 is rounded to improve the path of air flow.

As such, due to the rounded edges of the slots 38, the path of inlet air that passes through the slots 38 is improved so that inlet air is prevented from colliding with the edges of the openings when the air enters the pulley. Thereby, the flow rate of air that enters the pulley can be enhanced.

FIGS. 10 and 11A-11C illustrate the results of a test to configure the best shape of the pulley derived from the applicant of the present invention. The applicant of the present invention manufactured nine pulleys having different shapes and analyzed the air flow according to the shape of each of the pulleys from Case 1 to Case 9. Based on the results of the analysis, the optimum conditions that maximize the flow rate of air and the cooling efficiency were determined.

Figure 10:
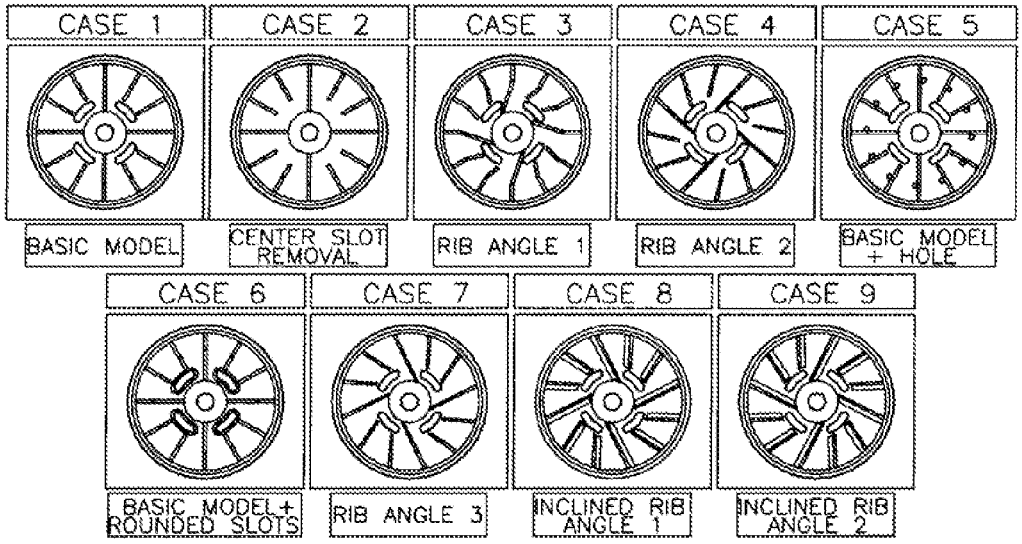

Case 1 of FIG. 10 is a pulley provided with ribs each of which is oriented along an axial center line, the pulley having slots. Case 2 is a pulley having a shape of Case 1 from which the slots have been removed. Case 3 is a pulley provided with ribs each of which extends a predetermined length and bends at a predetermined angle with respect to the axial center line. Case 4 is a pulley provided with ribs each of which is displaced at a predetermined angle from the axial center line. Case 5 is a pulley having a shape of Case 1 to which a plurality of holes have been added to increase the inflow rate of air. Case 6 is a pulley having a shape of Case 1 which has been rounded on the inner corner of a frame thereof. Case 7 is a pulley provided with ribs each of which is displaced at a predetermined angle relative to the axial center line, the pulley having a frame being rounded on the inner corner thereof. Case 8 is a pulley provided with ribs, each of which is displaced at a predetermined angle relative to the axial center line and has a ramp. Case 9 is a pulley provided with ribs, each of which is displaced at a predetermined angle from the axial center line in a direction opposite to that of Case 8 and has a ramp.

The result of a test for the velocity of air flow in Case 1 to Case 9 is shown in Table 1.

TABLE 1

| | z = 0.0 | | | | | | |
|---|---|---|---|---|---|---|---|
| | Max. Y | | y = −0.0014 | | Outlet y = −0.237 | | |
| | [m/sec] | Min. Y [m/sec] | Max. Y [m/sec] | Min. Y [m/sec] | Max. Y [m/sec] | Min. Y [m/sec] | Pressure [Pa] |
| CASE 1 | 9.464 | −2.217 | 9.698 | −1.771 | 5.916 | 3.962 | 113.05 |
| CASE 6 | 9.350 | −2.430 | 9.573 | −2.359 | 5.909 | 3.966 | 111.51 |
| CASE 5 | 9.372 | −3.031 | 9.594 | −1.898 | 5.925 | 3.952 | 111.13 |
| CASE 3 | 9.455 | −2.20 | 9.686 | −1.941 | 5.92 | 3.961 | 112.80 |
| CASE 4 | 9.453 | −2.202 | 9.687 | −1.947 | 5.92 | 3.961 | 112.77 |
| CASE 9 | 9.449 | −2.181 | 9.669 | −1.771 | 5.885 | 3.985 | 117.64 |
| CASE 7 | 9.460 | −2.130 | 9.643 | −1.871 | 5.882 | 3.979 | 114.89 |
| CASE 8 | 9.459 | −2.125 | 9.656 | −1.796 | 5.887 | 3.983 | 116.88 |
| CASE 2 | 9.839 | −2.346 | 10.08 | −0.974 | 5.91 | 3.929 | 119.20 |

According to Table 1, in Case 2, although the pressure difference was comparatively large, the flow of fluid was restrictive because there was not enough space to allow the fluid to flow, so that the efficiency of removing heat using air flow was not satisfied.

It can be understood that Case 3 and Case 4 have similar performance.

It was shown that although Case 1 and Case 6 have the same basic shape in which each rib is oriented along the axial center line, the performance of Case 6 is enhanced by having the rounded corner.

It was found that Case 8 and Case 9 have similar performance, and that the performance of the pulley having the shape of Case 9 is superior.

In Case 9, the outlet min. velocity was highest, and the pressure difference was the largest.

Figure 11A:
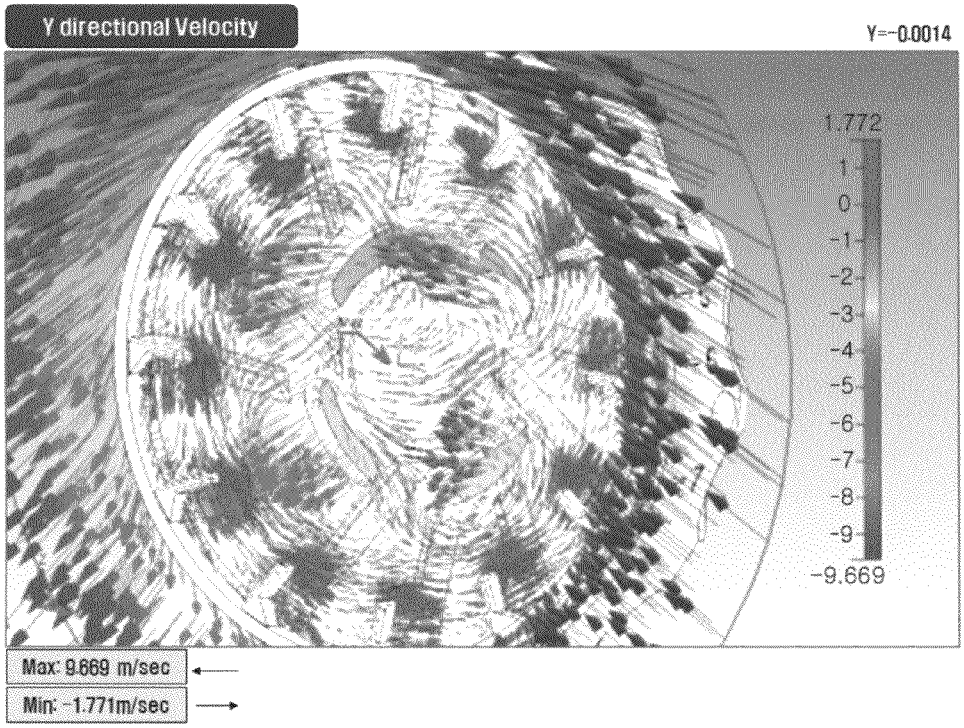
Figure 11B:
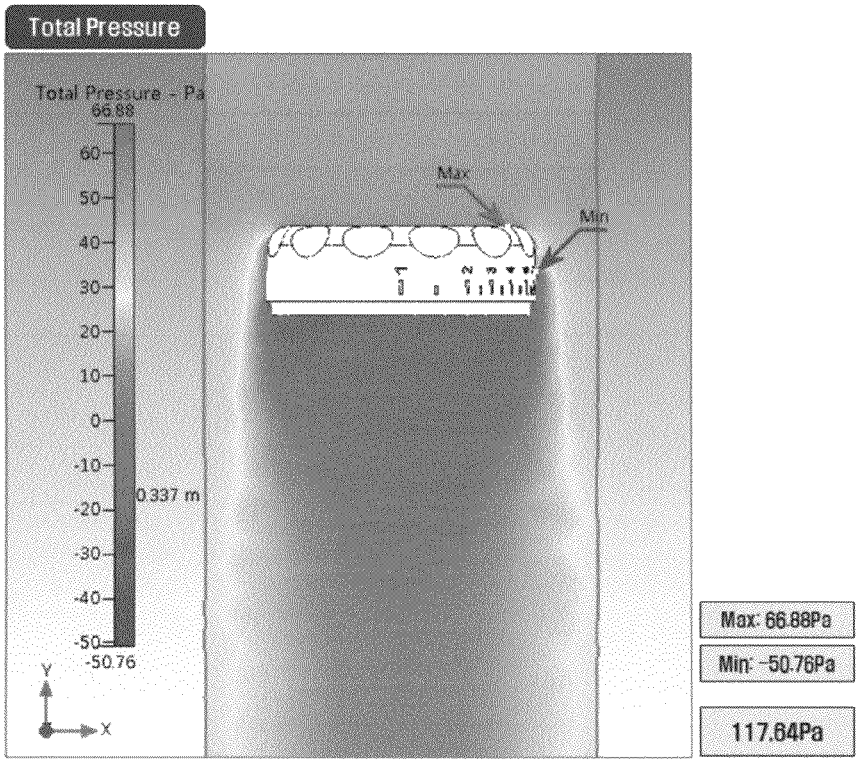
Figure 11C:
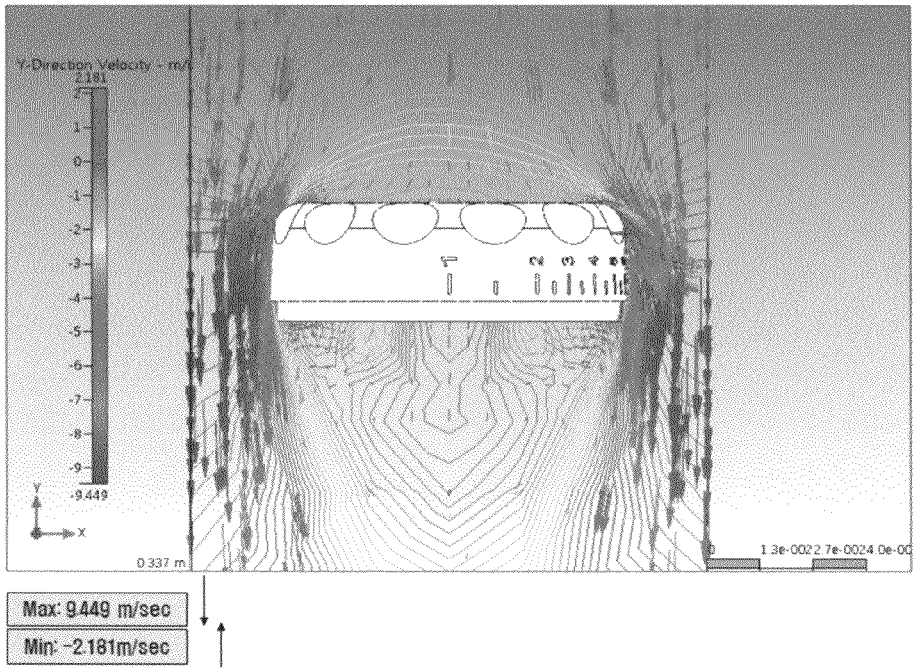

FIGS. 11A-11C show the result of a simulation analyzing the velocity and pressure for Case 9. FIG. 11A shows the flow of air, wherein a blue arrow indicates outside air that is drawn into the pulley and a red arrow indicates the air that is discharged from the pulley. FIG. 11B shows the distribution of pressure due to the inflow of air, wherein the total pressure indicates the pressure differential between an inlet and an outlet, which is commonly represented by the sum of static pressure and dynamic pressure. It can be seen from FIG. 11B that the degree and possibility of fluid dynamic vibrations/noise due to the irregular flow of a fluid may be determined. In general, it is necessary to minimize total pressure loss in order to remove swirls, and the total pressure drop should be further reduced in order to provide a larger amount of flux while driving the pulley at a fixed rate. FIG. 11C shows the distribution of air flow velocity, wherein the arrows indicate air flow. In general, it is ideal for the air to pass through the pulley at a constant velocity.

As such, it can be understood that in Case 9 in which each rib is displaced at a predetermined-angle relative to the axial center line and has a ramp, and the corner of the frame and the edge of each slot are rounded, the velocity of air flow is highest and the pressure difference is largest so that the flow rate of air can be markedly enhanced.

Furthermore, the conclusion can be drawn that a more satisfactory result is obtained by the structure in which each rib is displaced at a predetermined angle relative to the axial center line in the direction corresponding to the rotation of the pulley and has a ramp on one side surface thereof.

As described above, in a motor pulley for overlock sewing machines according to the present invention, each rib is displaced at a predetermined angle from an axial center line of a pulley. Hence, the direction of air flow is oriented outwards from the center of the pulley, thus reducing the pressure at the center of pulley, causing a pressure difference. Eventually, the flow rate of air that enters the pulley can increase.

Furthermore, a ramp is formed on one side surface of each rib that is a side surface corresponding to the direction in which air is drawn into the pulley by the rotation of the pulley. Thus, the path of air flow can be improved so that there is no air stagnant area, thereby further increasing the flow rate of air.

In addition, a corner of a frame of the pulley is rounded at an increased radius of curvature, thus improving the path of air flow so that there is no area in which the air is stagnant. Hence, the flow rate of air can be further enhanced.

Moreover, an edge of each of slots which are formed in the frame of the pulley is rounded. Thereby, the flow rate of air that enters the pulley can be further increased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A motor pulley for cooling a motor of an overlock sewing machine, comprising:

a disk-type frame forming a body of the motor pulley;

a plurality of ribs integrally formed with the frame, each of the ribs oriented in a radial direction at a predetermined angle displaced from an axial center line;

a ramp formed on one side surface of each of the ribs; and a slot formed in the frame to allow outside air to enter the motor pulley therethrough.

2. The motor pulley as set forth in claim 1, wherein each of the ribs is displaced at an angle ranging from 35° to 55° with respect to the axial center line.

3. The motor pulley as set forth in claim 1, wherein the ramp is formed in a direction in which air is drawn into the motor pulley when the motor pulley rotates, and an angle of the ramp ranges from 35° to 55°.

4. The motor pulley as set forth in claim 1, wherein a corner of an inner surface of the frame is rounded.

5. The motor pulley as set forth in claim 1, wherein an edge of the slot is rounded.

* * * * *